US007472690B2

(12) United States Patent
Takayanagi et al.

(10) Patent No.: US 7,472,690 B2
(45) Date of Patent: Jan. 6, 2009

(54) FUEL SUPPLY APPARATUS FOR ENGINE AND CONTROL METHOD OF SAME

(75) Inventors: Keiichi Takayanagi, Isesaki (JP); Junichi Furuya, Isesaki (JP); Yoshitatsu Nakamura, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 93 days.

(21) Appl. No.: 11/695,231

(22) Filed: Apr. 2, 2007

(65) Prior Publication Data

US 2007/0246021 A1 Oct. 25, 2007

(30) Foreign Application Priority Data

Apr. 24, 2006 (JP) ..... 2006-119003

(51) Int. Cl.
*F02M 37/04* (2006.01)
*F02M 57/02* (2006.01)
*F02M 63/00* (2006.01)

(52) U.S. Cl. ..... 123/446; 123/497; 123/447

(58) Field of Classification Search ..... 123/446, 123/447, 497, 458
See application file for complete search history.

(56) References Cited

U.S. PATENT DOCUMENTS 5,483,940 A * 1/1996 Namba et al. ..... 123/497
5,609,140 A * 3/1997 Kramer et al. ..... 123/497
5,723,780 A * 3/1998 Miwa et al. ..... 73/114.43
5,749,344 A * 5/1998 Yoshiume et al. ..... 123/399
5,775,304 A * 7/1998 Kono et al. ..... 123/497
5,937,826 A 8/1999 Olson et al.
6,024,072 A * 2/2000 Hamada ..... 123/497
6,209,521 B1 * 4/2001 Rembold et al. ..... 123/456
6,223,731 B1 * 5/2001 Yoshiume et al. ..... 123/497
6,293,757 B1 * 9/2001 Oda et al. ..... 417/53
6,367,454 B1 * 4/2002 Rembold et al. ..... 123/497
6,453,878 B1 * 9/2002 Mazet ..... 123/497
6,526,948 B1 * 3/2003 Stavnheim et al. ..... 123/497
7,107,968 B2 * 9/2006 Nomura ..... 123/456
2007/0251502 A1 * 11/2007 Takayanagi et al. ..... 123/458

FOREIGN PATENT DOCUMENTS

JP 2000-511992 9/2000
WO WO 99/45260 A2 9/1999

* cited by examiner

*Primary Examiner*—Thomas N Moulis
(74) *Attorney, Agent, or Firm*—Foley & Lardner LLP

(57) ABSTRACT

A fuel supply apparatus for an engine in which calculation of a manipulated variable of a fuel pump in response to a deviation between a fuel pressure detected by a fuel pressure sensor and a target value is carried out, is configured in a manner such that when the fuel pressure sensor is failed, a change in the fuel pressure is estimated based on a required fuel flow amount of an engine, a discharge amount of the fuel pump and a fuel pressure detected immediately before the fuel pressure sensor is failed, so that deciding of the manipulated variable of the fuel pump is made, based on the estimation value. A method of controlling the fuel supply apparatus to realize the controlling of the fuel pump based on the manipulated variable is also disclosed.

25 Claims, 8 Drawing Sheets

FUEL SUPPLY APPARATUS FOR ENGINE AND CONTROL METHOD OF SAME

BACKGROUND OF THE INVENTION

1. Field of the Invention

The present invention relates to a fuel supply apparatus for an engine, for controlling a fuel pump so that a fuel supply pressure applied to a fuel injection valve approaches a target value, and a control method thereof.

2. Description of the Related Art

Japanese Patent National Publication of Translated Version No. 2000-511992 discloses that, in a fuel supply apparatus for operating a fuel pump based on both a fuel pressure detected by a pressure sensor and a reference pressure, in the case where an abnormality in the pressure sensor is detected, the fuel pump is operated based on a required engine fuel amount and an engine rotating speed.

When the abnormality in the pressure sensor is detected, a discharge amount required for the fuel pump after an occurrence of the sensor abnormality depends on whether or not a pressure inside a fuel piping is boosted to the vicinity of a target pressure.

However, in the case where the fuel pump is operated based on both the required engine fuel amount and the engine rotating speed as in the conventional technology, since the fuel pump is operated so as to compensate for the fuel consumption, there is a problem in that the pressure inside the fuel piping cannot be boosted, resulting in the significant discrepancy between an actual fuel pressure and the target pressure.

Namely, in the fuel pump controlling operation based on both the required engine fuel amount and the engine rotating speed, although the fuel pressure can be held constant, the fuel pressure cannot be changed and consequently, sometimes, the fuel supply at the target pressure cannot be achieved.

SUMMARY OF THE INVENTION

The present invention has an object to make it possible to estimate a supply pressure of fuel applied to a fuel injection valve to thereby control an operation of a fuel pump based on an estimation value of the supply pressure.

In order to achieve the above object, according to the present invention, a supply pressure of fuel supplied to a fuel injection valve is estimated based on both a required engine fuel flow amount and a discharge amount of a fuel pump, to thereby control an operation of the fuel pump based on both an estimated supply pressure and a target value of the supply pressure.

More specifically, in accordance with one aspect of the present invention, there is provided a fuel supply apparatus for an engine, the apparatus being provided with: a fuel injection valve that injects fuel to the engine; a fuel pump that supplies the fuel to the fuel injection valve; a first detecting section that detects a required fuel flow amount of the engine;

a second detecting section that detects a discharge amount of the fuel pump; an estimating section that estimates a fuel supply pressure applied to the fuel injection valve, based on the required fuel flow amount of the engine and the discharge amount of the fuel pump; a first calculating section that calculates a manipulated variable of the fuel pump, based on the estimated supply pressure and a target value of the supply pressure; and a control section that controls the fuel pump based on the manipulated variable.

In accordance with another aspect of the present invention, there is provided a control method of a fuel supply apparatus which includes a fuel injection valve that injects fuel to an engine and a fuel pump that supplies the fuel to the fuel injection valve, the method including steps of: detecting a required fuel flow amount of the engine; detecting a discharge amount of the fuel pump; estimating a fuel supply pressure applied to the fuel injection valve, based on the required fuel flow amount of the engine and the discharge amount of the fuel pump; setting a target value of the fuel supply pressure applied to the fuel injection valve; calculating a manipulated variable of the fuel pump, based on the estimated supply pressure and the target value; and controlling the fuel pump based on the manipulated variable.

The other objects, features and advantages of this invention will become understood from the following description with reference to the accompanying drawings.

DESCRIPTION OF THE PREFERRED EMBODIMENTS

Figure 1:
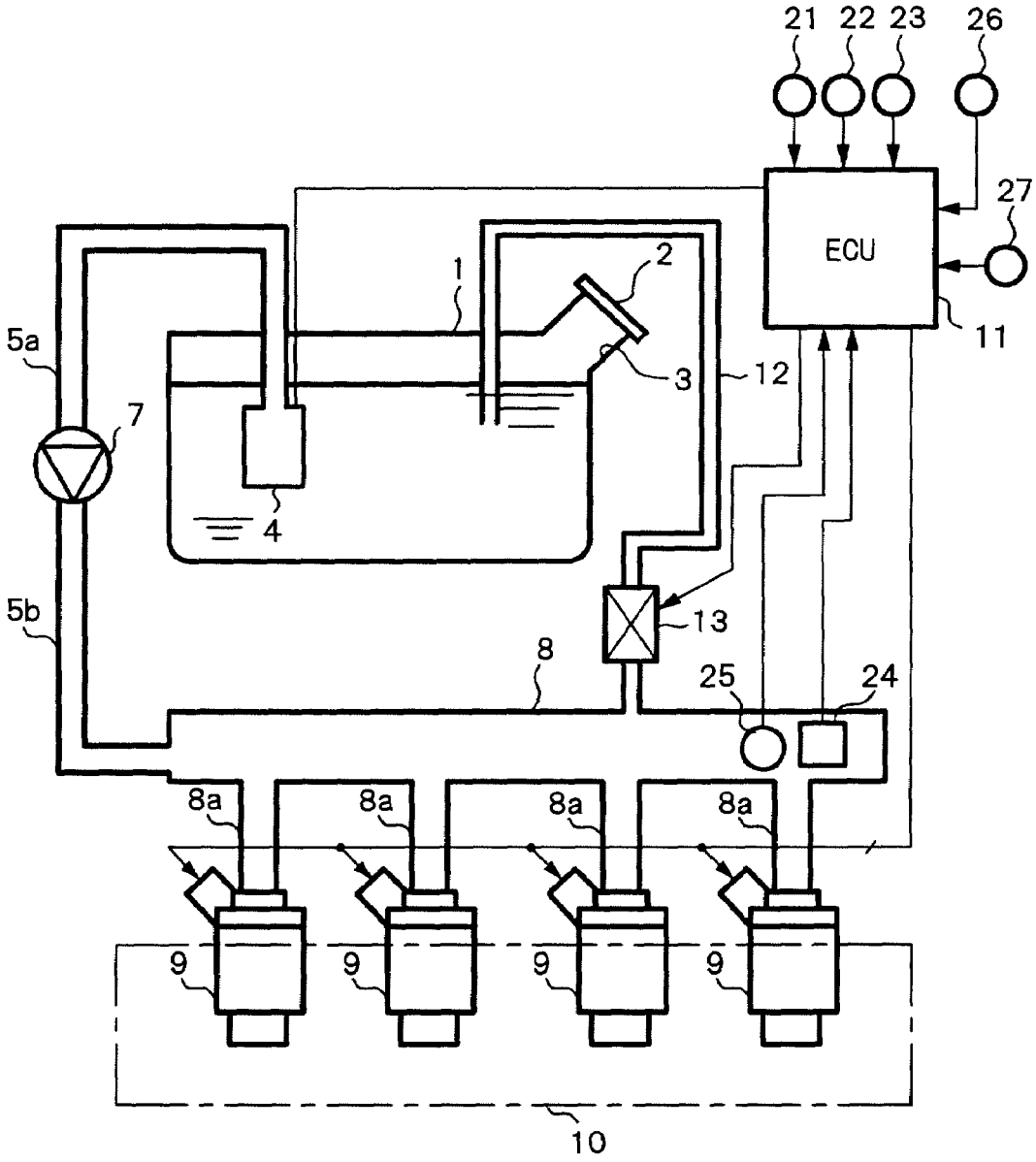
FIG. 1 is a systematic diagram of a fuel supply apparatus according to an embodiment of the present invention.

FIG. 1 is a diagrammatic view showing a fuel supply apparatus for a vehicle engine according to an embodiment.

In FIG. 1, a fuel tank 1 which reserves fuel (gasoline) for an engine (internal combustion engine) 10, is arranged below a rear seat of a vehicle, for example.

A fuel filler port 3 which is configured to be closed by means of a filler cap 2 is formed and opened on fuel tank 1, so that the fuel can be replenished through fuel filler port 3 into fuel tank 1 by uncapping filler cap 2.

Inside fuel tank 1, an electric fuel pump 4 is disposed via a bracket (not shown in the figure).

Fuel pump 4 is, for example, a turbine type pump which sucks the gasoline in fuel tank 1 through a suction port thereof and discharges it through a discharge port thereof, which discharge port is connected to one end of a fuel pipe 5*a*.

The other end of fuel pipe 5*a* is connected to an inlet port side of a check valve 7 which is arranged so as to permit passage of the fuel flow from fuel pump 4 toward a later described fuel injection valves 9 but to block an inverse fuel flow from fuel injection valves 9 toward fuel pump 4.

To an outlet port of check valve 7, one end of a fuel pipe 5*b* is connected, and the other end of fuel pipe 5*b* is connected to a fuel gallery pipe 8.

Namely, fuel pipe 5*a*, fuel pipe 5*b* and fuel gallery pipe 8 are provided to produce a pressure feed path led from fuel pump 4 toward fuel injection valves 9.

To fuel gallery pipe 8, there are disposed injection valve connecting portions 8*a* of the number same as the number of cylinders (4 cylinders are employed in the present embodiment) along an extending direction of fuel gallery pipe 8, and fuel inlet ports of fuel injection valves 9 are respectively connected to injection valve connecting portions 8*a*.

Each of fuel injection valves 9 is an electromagnetic injection valve in which, when a magnetic suction force is generated by a power supply to an electromagnetic coil, a valve body urged by a spring to a valve closing direction is lifted up, so that the valve is opened to thereby inject the fuel.

Fuel injection valves 9 are respectively disposed to intake port portions of the respective cylinders of engine 10, to injection supply the fuel to the respective cylinders.

Further, there is disposed a relief pipe 12 which communicate the inside of fuel gallery pipe 8 with the inside of fuel tank 1. An electromagnetic relief valve 13 is disposed in relief pipe 12.

Electromagnetic relief valve 13 is driven to open when the power is supplied thereto, while maintaining a closed state when no power is supplied thereto.

When electromagnetic relief valve 13 is driven to open, the fuel in fuel gallery pipe 8 is discharged via relief pipe 12 into fuel tank 1, so that a fuel pressure in fuel gallery pipe 8 is lowered.

An electronic control unit 11 incorporating therein a microcomputer outputs individual valve opening control pulse signals to respective fuel injection valves 9, to control a fuel injection amount and injection timing of each fuel injection valve 9.

Further, electronic control unit 11 duty controls the ON/OFF of the power supply supplied to fuel pump 4 to change a drive current (drive voltage), to thereby control a discharge amount of fuel pump 4, and also, electronic control unit 11 switching controls the ON/OFF of the power supply supplied to electromagnetic relief valve 13, to control the fuel discharge from the inside of fuel gallery pipe 8.

Electronic control unit 11 receives detection signals from sensors of various types.

The sensors of various types include: an air flow meter 21 for detecting an intake air flow amount of internal combustion engine 10; a crank angle sensor 22 for outputting a detection signal at each predetermined crank angle position; a water temperature sensor 23 for detecting the cooling water temperature Tw of internal combustion engine 10; a fuel pressure sensor 24 for detecting a fuel pressure in fuel gallery pipe 8; a fuel temperature sensor 25 for detecting the temperature of the fuel in fuel gallery pipe 8; an air-fuel ratio sensor 26 for detecting oxygen concentration in exhaust gas, which correlates with an air-fuel ratio in engine 10 and the like.

Further, electronic control unit 11 receives an on/off signal of a starter switch 27 of engine 10.

Then, electronic control unit 11 calculates injection pulse width appropriate to a fuel amount which is capable of forming the air-fuel mixture of a target air-fuel ratio, based on the detection signals from air flow meter 21, crank angle sensor 22, water temperature sensor 23, air-fuel ratio sensor 26 and the like, to output the valve opening control pulse signal with the calculated injection pulse width to each fuel injection valve 9.

Further electronic control unit 11 feedback controls a power supply control duty (manipulated variable) of fuel pump 4 so that an actual fuel pressure detected by fuel pressure sensor 24 approaches a target fuel pressure, and in the above injection pulse width calculation, electronic control unit 11 calculates the injection pulse width so that a required fuel amount is injected under a fuel pressure condition in fuel gallery pipe 8.

Figure 2:
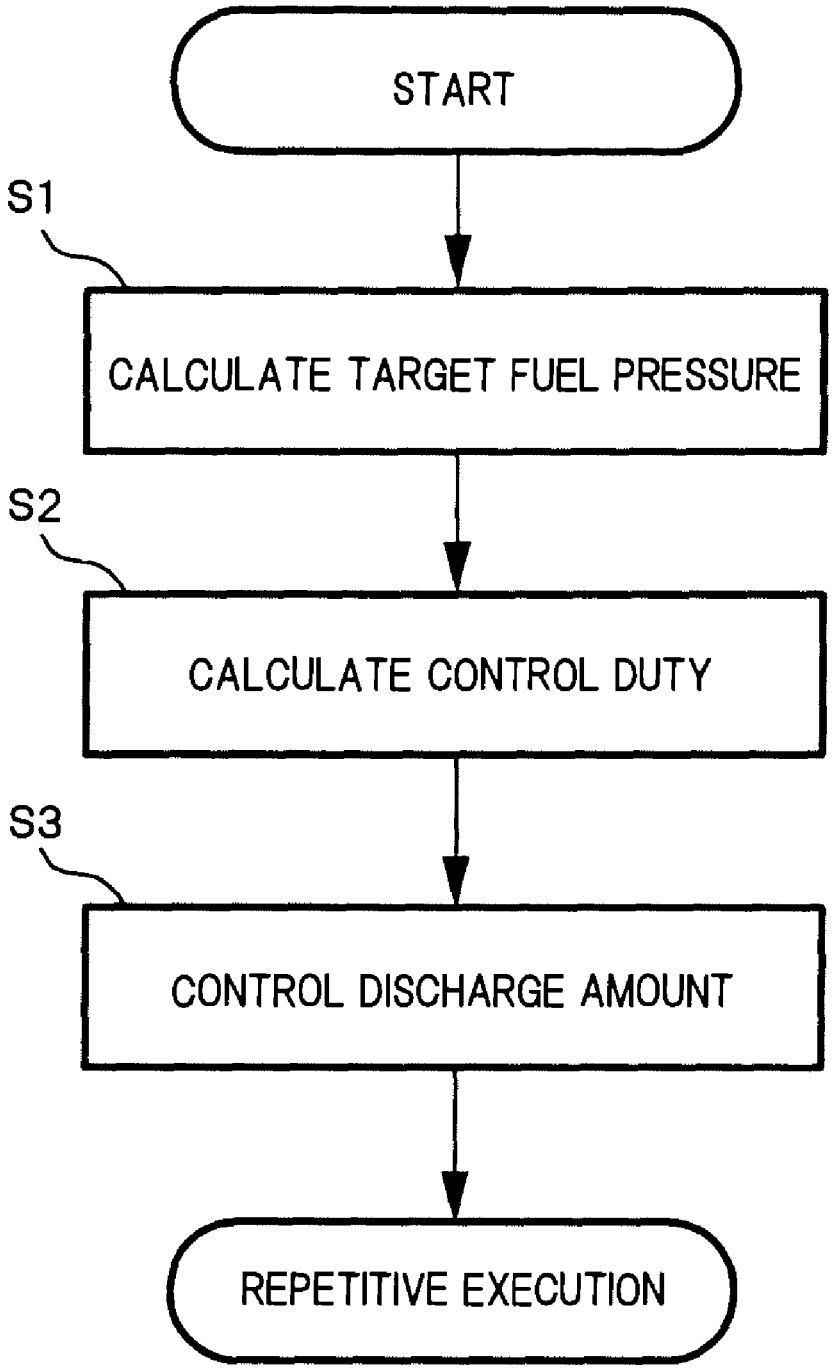
FIG. 2 is a flowchart showing a main routine of a fuel pump controlling operation according to the embodiment of the present invention.

A flowchart of FIG. 2 shows a main routine of the feedback control of fuel pump 4. Incidentally, routines shown in the following are all executed at each predetermined minute time.

Firstly, in step S1, the target fuel pressure is calculated based on a load of the engine, a rotating speed thereof, the water temperature thereof and the like.

In next step S2, the control duty of fuel pump 4 is calculated based on both the target fuel pressure calculated in step S1 and the fuel pressure in fuel gallery pipe 8.

In step S3, the ON/OFF of the power supply supplied to fuel pump 4 is controlled based on the control duty calculated in step S2, to thereby control the discharge amount of fuel pump 4.

Figure 3:
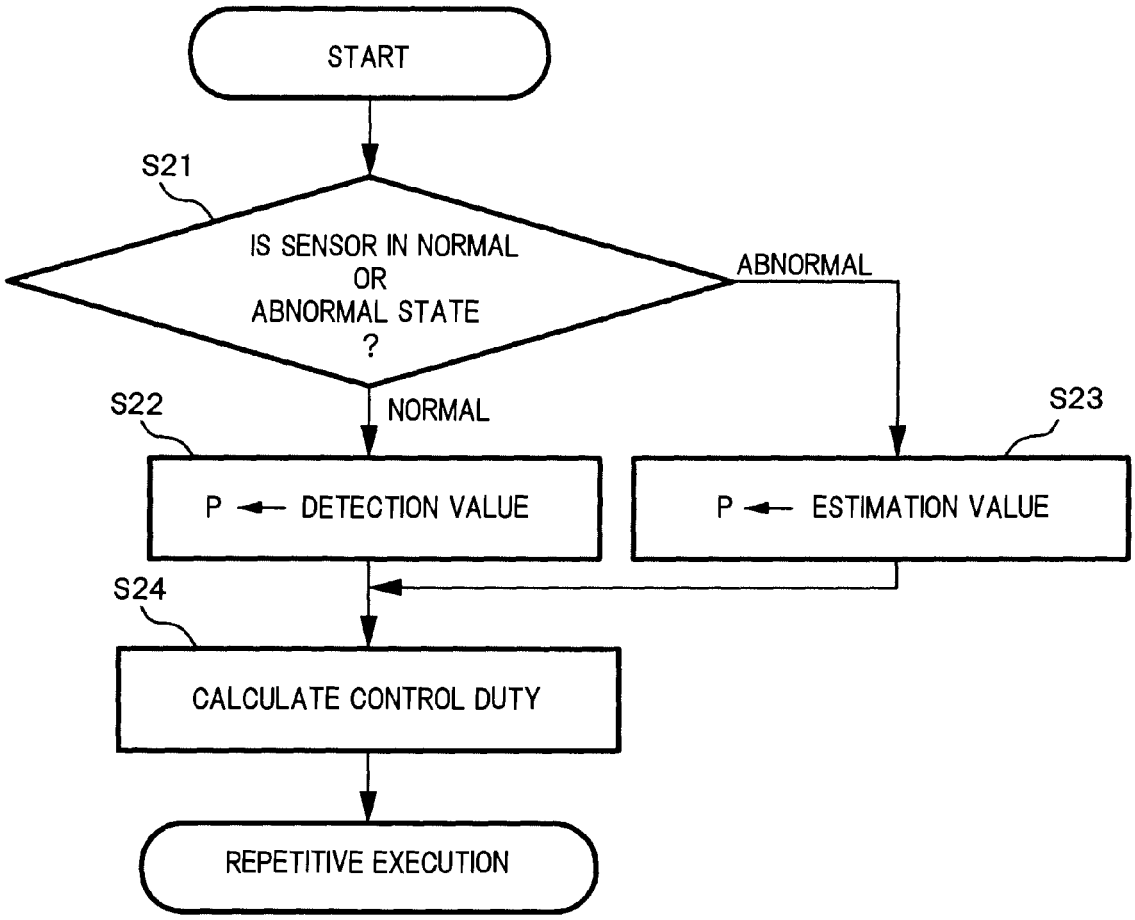
FIG. 3 is a flowchart showing the setting of an actual fuel pressure according to the embodiment of the present invention.

A flowchart of FIG. 3 shows the details of calculation processing of the control duty in step S2.

In step S21, it is determined whether fuel pressure sensor 24 is in either a normal state or in an abnormal state.

Then, when fuel pressure sensor 24 is in the normal state, the routine proceeds to step S22, where a detection value of fuel pressure sensor 24 is set to a fuel pressure value P to be used for the fuel pump controlling operation.

On the other hand, when fuel pressure sensor 24 is in the abnormal state, the routine proceeds to step S23, where an estimation value of the fuel pressure in fuel gallery pipe 8 is set to the fuel pressure value P to be used for the fuel pump controlling operation.

Namely, when fuel pressure sensor 24 is in the abnormal state, the detection result of fuel pressure sensor 24 does not indicate the actual fuel pressure. For this reason, the fuel pressure in fuel gallery pipe 8 is estimated instead, to thereby control the discharge amount of fuel pump 4 so that the estimation value approaches the target fuel pressure.

In step S24, the control duty of fuel pump 4 is calculated based on both the target fuel pressure and the fuel pressure value P.

To be specific, the control duty is calculated by using a previously stored coefficient $\alpha$, and by an equation as follows:

$$\text{control duty}=(\text{target fuel pressure}-\text{fuel pressure value } P)\times\alpha$$

Hence, on the basis of the above calculation, feedback control of the control duty of fuel pump 4 is carried out so that the actual fuel pressure approaches the target fuel pressure.

Figure 4:
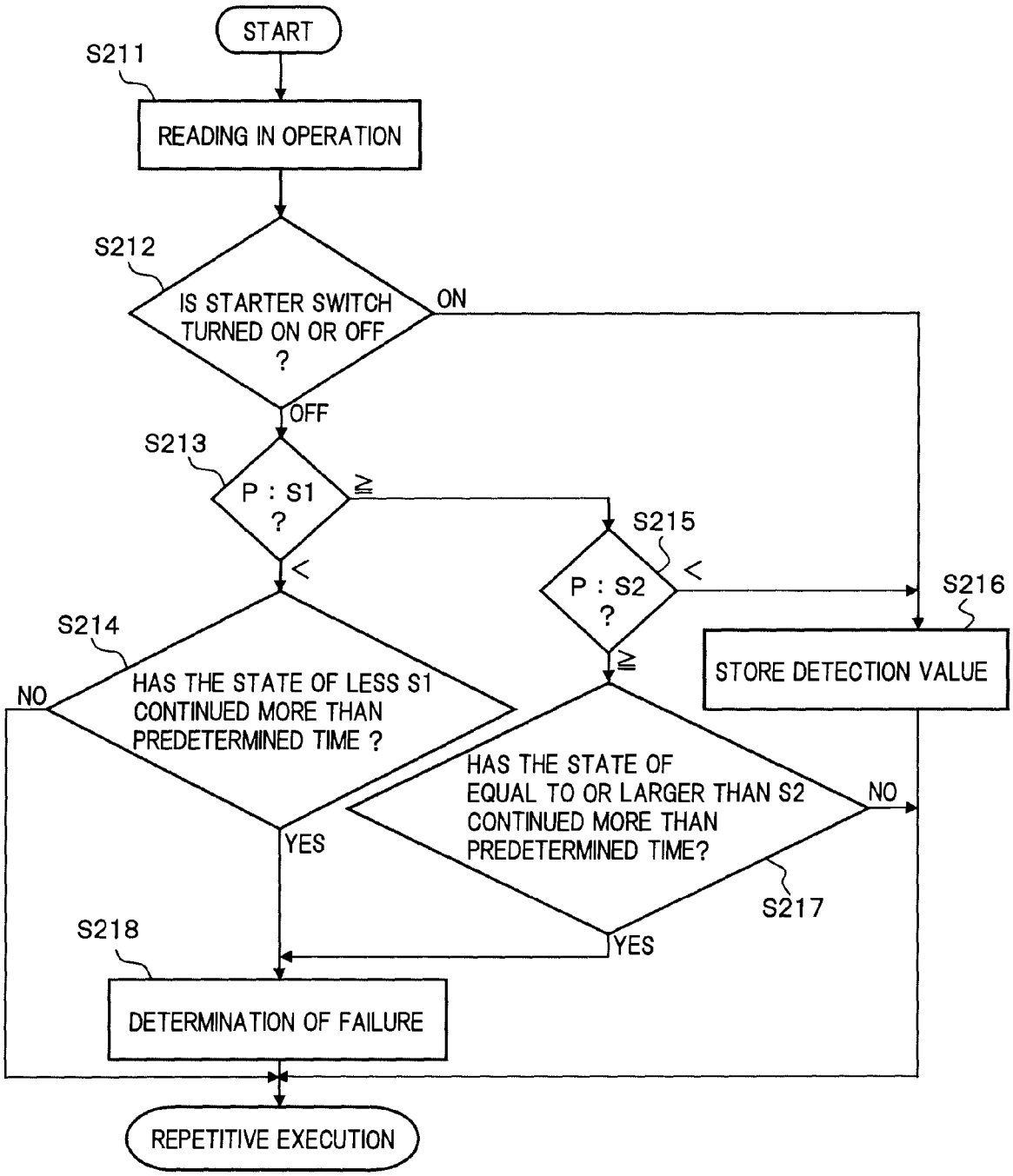
FIG. 4 is a flowchart showing the failure diagnosis of a fuel pressure sensor according to the embodiment of the present invention.

A flowchart of FIG. 4 shows the details of the abnormality determination processing in step S21.

However, the method of abnormality determination of fuel pressure sensor 24 is not limited to the method shown in the flowchart of FIG. 4, and known diagnosis methods of various types may be applied.

In step S211, the detection result of fuel pressure sensor 24 is read in.

In step S212, it is determined whether starter switch 27 of engine 10 is turned ON or OFF.

Then, when operations of engine 10 have been started (starter switch 27 was turned OFF), the routine proceeds to step S213, where it is determined whether or not the detection result read in step S211 is equal to or larger than a set value S1.

The set value S1 is previously stored as a value that the detection result of fuel pressure sensor 24 does not come below the value so long as the operation of fuel pressure sensor 24 is in the normal state.

Here, when the detection result read in step S211 is less than the set value S1, the routine proceeds to step S214, where it is determined whether or not a state where the detection value is below the set value S1 continues for over a predetermined period of time.

Then, in the case where the detection result of fuel pressure sensor 24 is below the set value S1 for over the predetermined period of time, the routine proceeds to step S218, where it is determined that the fuel pressure sensor is in the abnormal state.

On the other hand, in the case where, even in the state where the detection result of fuel pressure sensor 24 is less than the set value S1, if duration of such a state does not reach the predetermined period of time, step S218 is bypassed and the present routine is terminated.

When it is determined in step S213 that the detection result of fuel pressure sensor 24 is equal to or larger than the set value S1, the routine proceeds to step S215.

In step S215, it is determined whether or not the detection result read in step S211 is equal to or less than a set value S2.

The set value S2 is previously stored as a value that the detection result of fuel pressure sensor 24 does not exceed the value so long as the operation of fuel pressure sensor 24 is in the normal state, and the set value S2 is larger than the set value S1 (the set value S1<the set value S2).

When it is determined in step S215 that the detection result of fuel pressure sensor 24 is less than the set value S2, since the detection result of fuel pressure sensor 24 is within a normal range between the set value S1 and the set value S2 (>the set value S1), it is determined that fuel pressure sensor 24 is in the normal state, and the routine proceeds to step S216.

In step S216, the detection result read in step S211 at this time is stored as a detection value immediately before the failure.

On the other hand, when it is determined in step S215 that the detection result of fuel pressure sensor 24 is equal to or larger than the set value S2, the routine proceeds to step S217, where it is determined whether or not a state where the detection result of fuel pressure sensor 24 is equal to or larger than the set value S2 continues for over a predetermined period of time.

Then, in the case where the detection result of fuel pressure sensor 24 is equal to or larger than the set value S2 for over the predetermined period of time, the routine proceeds to step S218, where it is determined that fuel pressure sensor 24 is in the abnormal state.

On the other hand, in the case where, even in the state where the detection result of fuel pressure sensor 24 is equal to or larger than the set value S2, if duration of such a state does not reach the predetermined period of time, step S218 is bypassed and the present routine is terminated.

Figure 5:
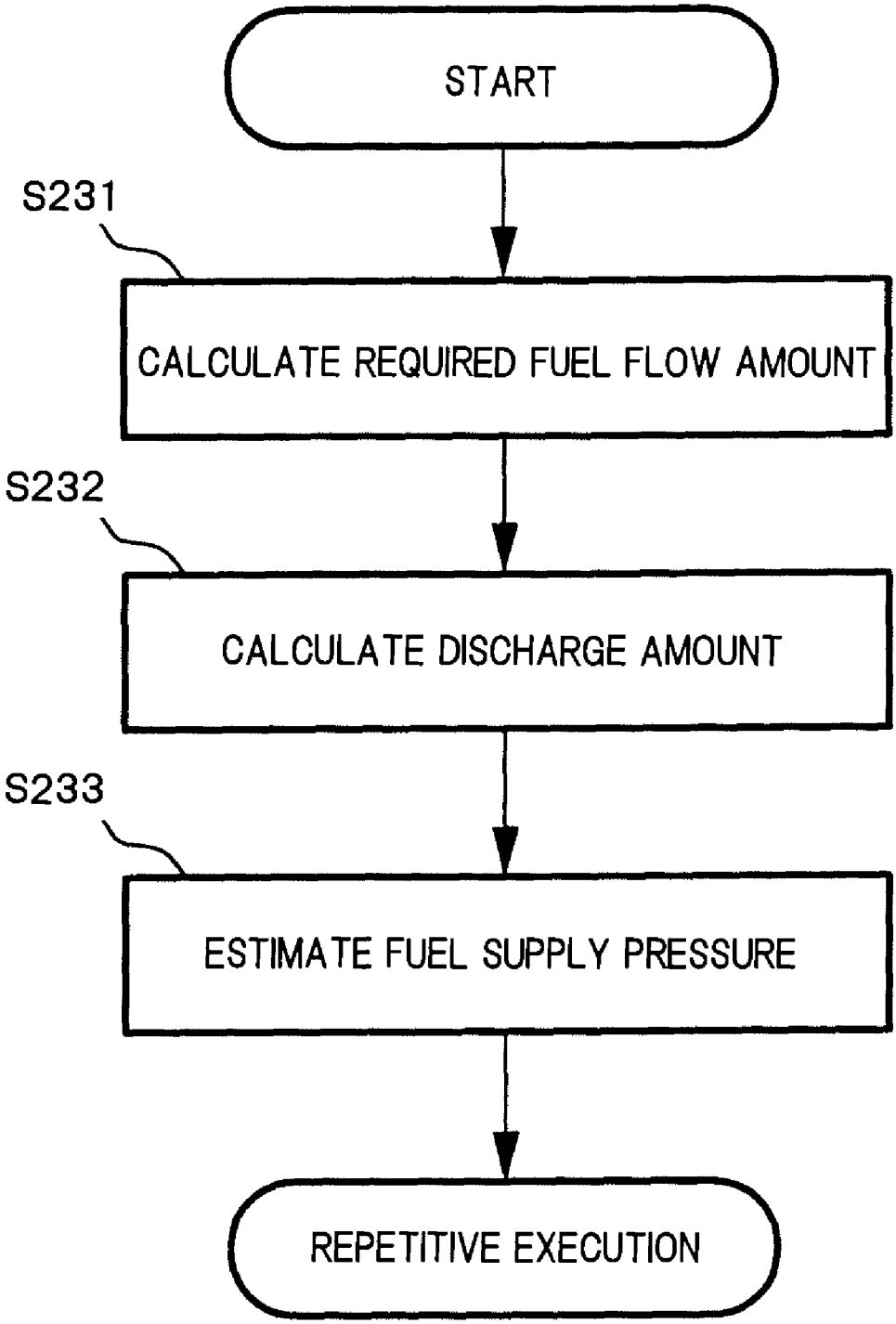
FIG. 5 is a flowchart showing the estimation of a fuel pressure according to the embodiment of the present invention.

A flowchart of FIG. 5 shows the processing of calculating the fuel pressure estimation value to be used in step S23.

In step S231, a required fuel flow amount of engine 10 is calculated.

To be specific, the required fuel flow amount is calculated as follows:

$$\text{the required fuel flow amount}=(Tl\times cyl\times\beta)\times Ne\times HOS$$

where Tl is the injection pulse width, cyl the number of fuel injection valves 9, β a coefficient for converting the opening time of fuel injection valve 9 into the fuel flow amount, Ne (rpm) the engine rotating speed, and HOS a fuel pressure based correction coefficient.

In step S232, the discharge amount of fuel pump 4 at the time is calculated.

The discharge amount is calculated based on both a discharge amount at a previously stored reference voltage time and a control duty (manipulated variable) at the time.

In step S233, the fuel supply pressure is estimated, based on the required fuel flow amount calculated in step S231, which is equivalent to a fuel amount to be carried away from the inside of fuel piping, the discharge amount of fuel pump 4 calculated in step S232, which is a fuel amount newly supplied to the inside of the fuel piping, and an initial value of the estimation value.

In the above fuel supply pressure estimation, it is possible to correct the estimation result according to the shape of piping or the fuel temperature.

Figure 6:
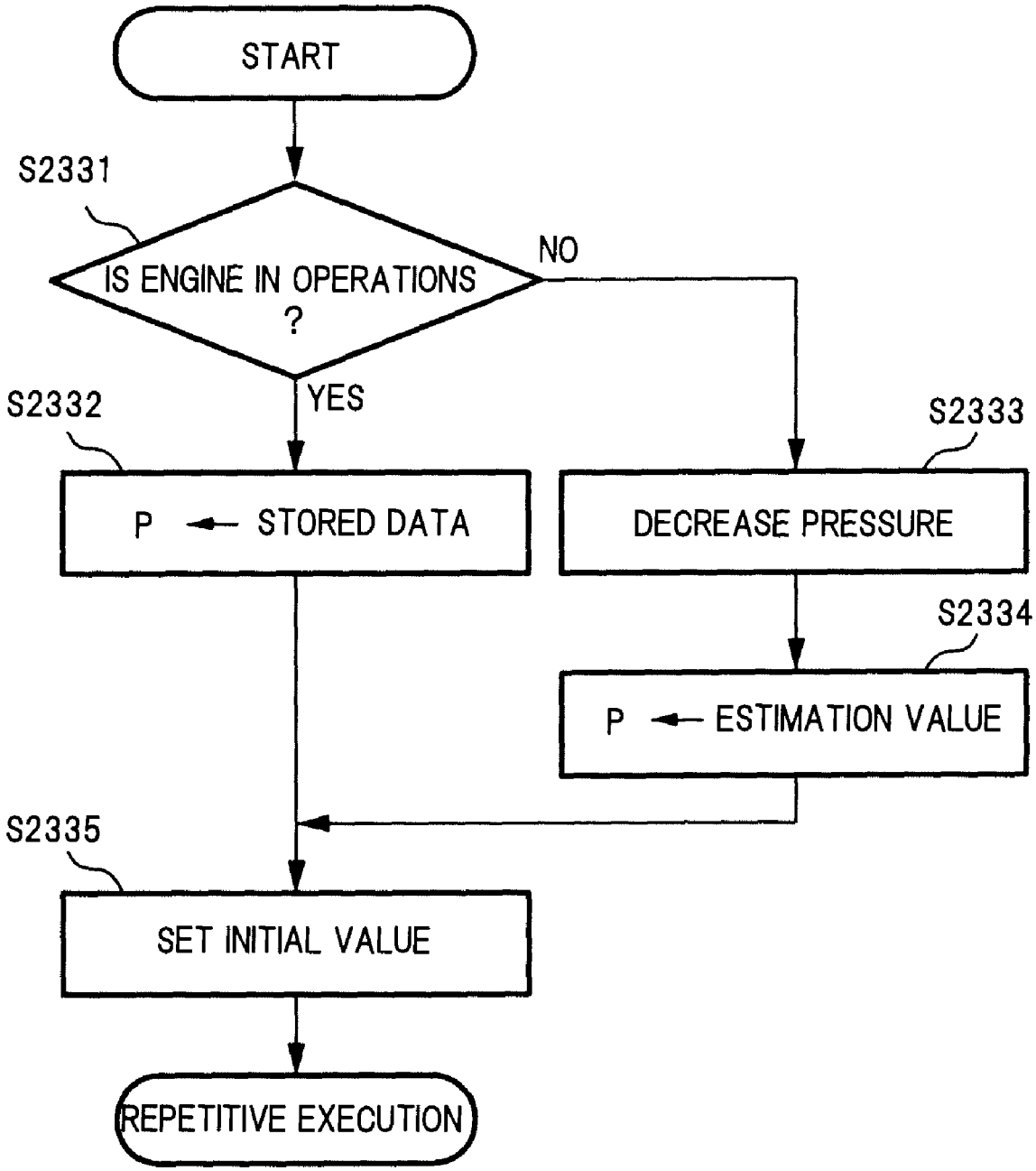
FIG. 6 is a flowchart showing the setting of an initial value according to the embodiment of the present invention.

A flowchart of FIG. 6 shows the calculation processing of the initial value to be used for the estimating calculation of the fuel supply pressure in step S233.

In step S2331, it is determined whether or not the engine is operated.

Then, if the engine is operated, the routine proceeds to step S2332, where the fuel pressure immediately before the failure which is set and updated in step S216 is set as the initial value of the estimation value.

On the other hand, if the engine is not operated, the routine proceeds to step S2333, where electromagnetic relief valve 13 is driven to be opened, to thereby relieve the fuel from the inside of fuel gallery pipe 8 into fuel tank 1, until the fuel pressure in fuel gallery pipe 8 is lowered to 0 kPa.

However, means for lowering the fuel pressure in fuel gallery pipe 8 to 0 kPa is not limited to the above processing for driving the opening of electromagnetic relief valve 13, and it is possible to adopt such a means for relieving the fuel in the fuel piping to reset the fuel pressure in the piping to a predetermined pressure, for example, by reversing fuel pump 4 to return the fuel in the fuel piping to fuel tank 1 without using check valve 7 or by disposing a volumetric chamber communicated with the fuel piping to open a passage to the volumetric chamber.

In step S2334, the fuel pressure after the start of relief processing is estimated, based on the fuel pressure immediately before the failure, which is set and updated in step S216, a previously stored decreasing pressure amount per unit time in the case where electromagnetic relief valve 13 is driven to be opened, and an elapsed time t from electromagnetic relief valve 13 is driven to be opened, and then the estimated fuel pressure is set to the initial value of the estimation value.

In step S2335, the initial value of the estimation value is decided.

Accordingly, in the case where the fuel pressure sensor is failed during the operation of engine 10, the detection value immediately before the failure is set as the initial value and thereafter, the fuel supply pressure is estimated based on both the required fuel flow amount and the discharge amount. In the case where the operation of engine 10 is started in the state where fuel pressure sensor 24 is failed, the fuel supply pressure is once reset to 0 kPa, and the fuel supply pressure is estimated based on the required fuel flow amount and the discharge amount using 0 kPa as the initial value.

According to the above embodiment, even if fuel pressure sensor 24 is failed, the actual fuel supply pressure is estimated based on the required fuel flow amount of engine 10 and the discharge amount of fuel pump 4, to thereby control the discharge amount of fuel pump 4. Therefore, even in the case where fuel pressure sensor 24 is failed in a state where the fuel pressure is not increased to the vicinity of the target pressure, the target pressure can be held after the fuel pressure is increased to the vicinity of the target pressure, so that the fuel injection by fuel injection valves 9 can be performed in substantially equivalent to such the fuel injection in the normal state of fuel pressure sensor 24.

Further, when the actual fuel supply pressure is estimated based on the required fuel flow amount of engine 10 and the discharge amount of fuel pump 4, the detection value detected at when fuel pressure sensor 24 is in the normal state is set as the initial value, so that the estimating accuracy of the fuel pressure can be ensured.

Furthermore, during the engine operation stop, the fuel supply pressure is once reset to 0 kPa, and the fuel supply pressure is estimated based on the required fuel flow amount and the discharge amount using 0 kPa as the initial value. Therefore, it becomes possible to perform the estimation using the further accurate initial value as a reference.

In the control of fuel pump 4, in either of the case where the detection result of fuel pressure sensor 24 is used or the case where the estimation value is used, the discharge amount of fuel pump 4 is changed according to the deviation of the fuel supply pressure from the target fuel pressure, and therefore, there is a possibility that a large control error is caused due to a response delay in the controlling operation at the transient operation time during which the required fuel flow amount is significantly changed.

Figure 7:
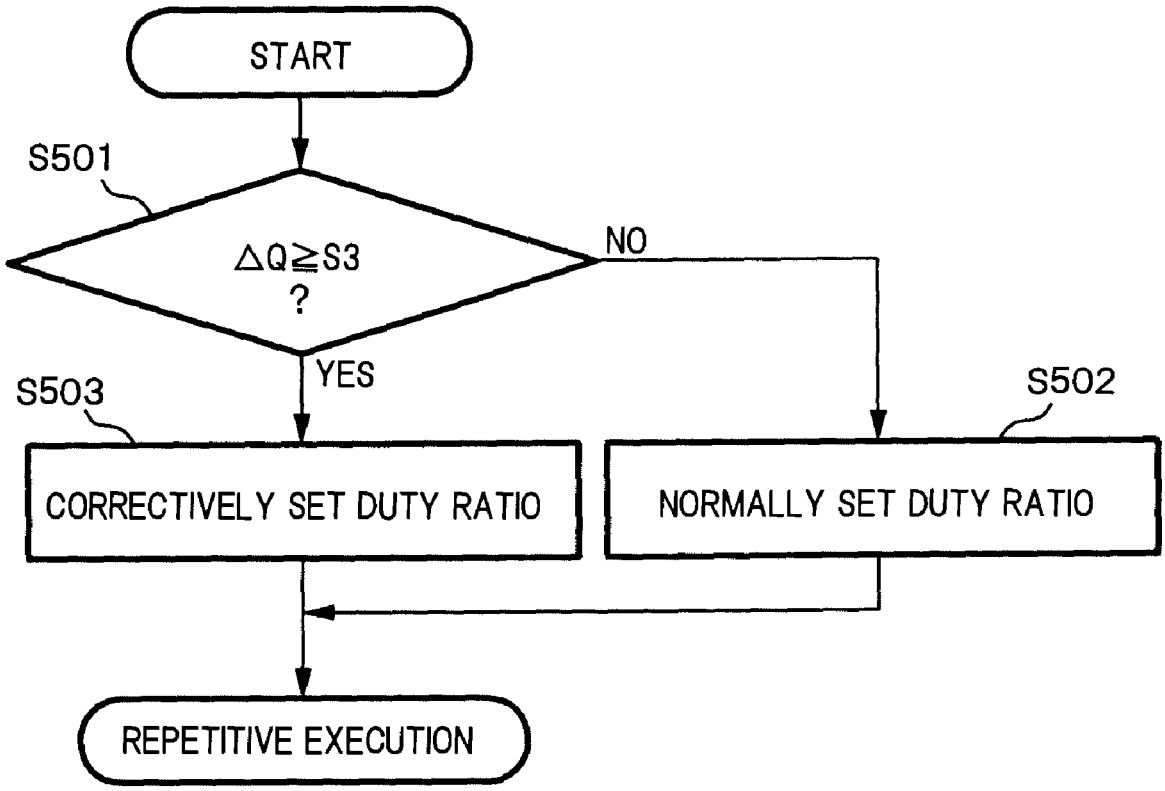
FIG. 7 is a flowchart showing a correction controlling operation during transient operations according to the embodiment of the present invention.

Therefore, as shown in a flowchart of FIG. 7, it is preferable to correctively control the discharge amount at the transient operation time.

In the flowchart of FIG. 7, in step S501, it is determined whether or not the deviation ΔQ between a latest value and a previous value of a detection result of intake air amount is equal to or larger than a set value S3. The deviation ΔQ (ΔQ=latest value−previous value) is a time derivative value of the intake air amount.

Here, if the deviation ΔQ is less than the set value S3, the routine proceeds to step S502, where a duty ratio of fuel pump 4 is normally set.

In step S502, the duty ratio is calculated in accordance with the following equation.

$$\text{Duty ratio}=(\text{target fuel pressure}-P)\times\alpha$$

On the other hand, in the case where the deviation ΔQ is equal to or larger than the set value S3 and the intake air amount is increasingly changed at over a predetermined speed, the routine proceeds to step S503, where a correction amount is added to thereby set the duty ratio of fuel pump 4.

The correction amount at the transient operation time is calculated in accordance with the following equation, based on the deviation ΔQ and a previously stored coefficient γ.

$$\text{Correction amount}=\Delta Q\times\gamma$$

Then, the duty ratio is calculated in accordance with the following equation.

$$\text{Duty ratio}=(\text{target fuel pressure}-P)\times\alpha+\Delta Q\times\gamma$$

As described in the above, if the manipulated variable of fuel pump 4 is corrected at the transient operation time, it is possible to avoid that the fuel pressure is significantly varied due to the response delay in the control, and the fuel metering by fuel injection valve 9 can be accurately performed at the transient operation time.

Further, in the case where the discharge amount of fuel pump 4 is controlled without using fuel pressure sensor 24, there is a possibility that the steady fuel pressure deviation occurs to cause an error of certain rate in the fuel injection amount, and thus, the air-fuel ratio is deviated from a target air-fuel ratio.

Figure 8:
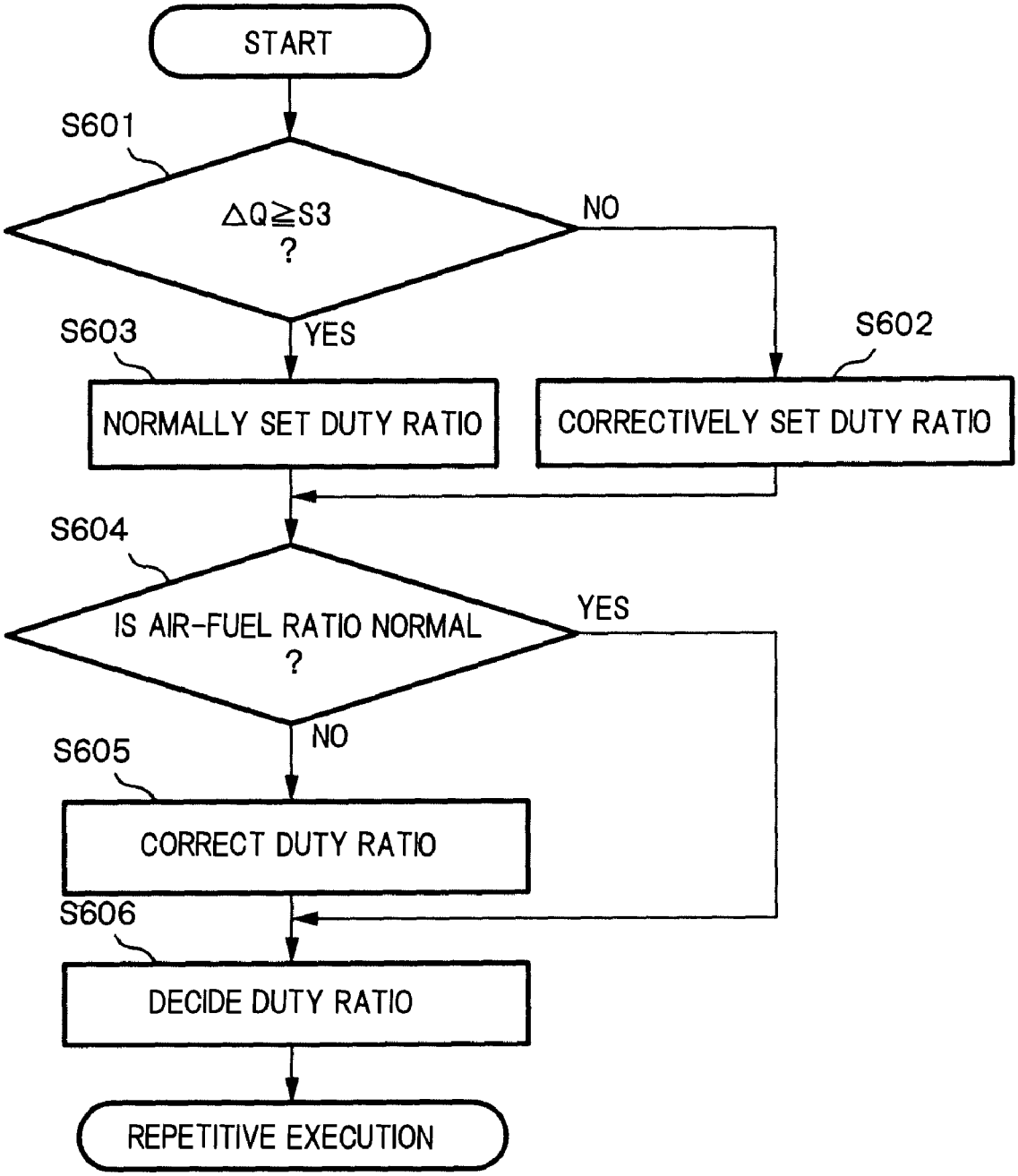
FIG. 8 is a flowchart showing the correction during transient operations and the correction based on an air-fuel ratio according to the embodiment of the present invention.

Therefore, as shown in a flowchart of FIG. 8, it is preferable to perform the correction in response to the air-fuel ratio deviation together with the correction at the transient operation time.

Incidentally, only the correction in response to the air-fuel ratio deviation may be performed without performing the correction at the transient operation time.

In the flowchart of FIG. 8, firstly in steps S601 to S603, similarly to steps S501 to S503, the duty ratio of fuel pump 4 is corrected according to the changing speed of the intake air amount, at the transient operation time.

Further, in step S604, it is determined whether or not the air-fuel ratio detected by air-fuel ratio sensor 26 is within a normal range centered around the target air-fuel ratio, and if the air-fuel ratio is within the normal range, the routine proceeds to step S606, where the duty on which only the correction at the transient operation time is performed is set to an eventual duty.

On the other hand, in step S604, in the case where the air-fuel ratio detected by air-fuel ratio sensor 26 is without the normal range and is deviated from the target air-fuel ratio by a predetermined amount or more, the routine proceeds to step S605.

In step S605, the correction according to the deviation between the target air-fuel ratio and the actual air-fuel ratio detected by air-fuel ratio sensor 26 is performed on the duty ratio of fuel pump 4.

To be specific, the duty ratio is corrected in accordance with the following equation.

$$\text{Duty ratio}=\text{duty ratio}+(\text{target air-fuel ratio}-\text{actual air-fuel ratio})\times K$$

In the above equation, K is a previously stored constant.

In next step S606, the duty ratio on which the correction according to the air-fuel ratio deviation is performed is set to an eventual duty ratio.

Thus, when the air-fuel ratio deviation occurs, by correcting the duty ratio, the deviation of the air-fuel ratio due to the estimation error in the actual fuel pressure is resolved, so that the desired combustion in the target air-fuel ratio can be performed, and the exhaust performance and the fuel consumption performance can be maintained.

Incidentally, according to the above embodiment, in the system provided with fuel pressure sensor 24, when fuel pressure sensor 24 is failed, the fuel supply pressure is estimated based on both the required fuel flow amount and the discharge amount. However, in a system which is not provided with fuel pressure sensor 24, the discharge amount of fuel pump 4 can be always controlled using the estimation value.

In the case where fuel pressure sensor 24 is not provided, it is difficult to perform the estimation controlling operation using the value immediately before the failure of fuel pressure sensor 24 as the initial value, but instead, by operating electromagnetic relief valve 13 during the engine stop to thereby lower the fuel supply pressure to 0 kPa, it is possible to estimate the fuel supply pressure using 0 kPa as the initial value.

Here, it is possible to determine whether or not the fuel supply pressure is lowered to 0 kPa, by determining whether or not the relief processing is performed for over a predetermined period of time.

The estimation value of the fuel supply pressure can be used for the discharge amount control of fuel pump 4, and also can be used for the correction of injection pulse width of fuel injection valve 9.

Further, as the controlling operation for approaching the actual fuel supply pressure applied to the target value, it is possible to adjust the relief amount by the controlling operation of electromagnetic relief valve 13 together with the discharge amount control of fuel pump 4.

The entire contents of Japanese Patent Application No. 2006-119003 filed on Apr. 24, 2006, a priority of which is claimed, are incorporated herein by reference.

While only a selected embodiment has been chosen to illustrate the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and not for the purpose of limiting the invention as defined in the appended claims and their equivalents.

We claim:

1. A fuel supply apparatus for an engine, comprising:

a fuel injection valve that injects fuel to the engine;

a fuel pump that supplies the fuel to the fuel injection valve;

a first detecting section that detects a required fuel flow amount of the engine;

a second detecting section that detects a discharge amount of the fuel pump;

an estimating section that estimates a fuel supply pressure applied to the fuel injection valve, based on the required fuel flow amount of the engine and the discharge amount of the fuel pump;

a first calculating section that calculates a manipulated variable of the fuel pump, based on the estimated supply pressure and a target value of the supply pressure; and a control section that controls the fuel pump based on the manipulated variable.

2. The apparatus according to claim 1, further comprising;

an initial value setting section that sets an initial value of the estimation value of the supply pressure, wherein the estimating section estimates the fuel supply pressure applied to the fuel injection valve, based on the required fuel flow amount of the engine, the discharge amount of the fuel pump and the initial value.

3. The apparatus according to claim 2, further comprising;

a pressure regulator that forcibly changes the fuel supply pressure applied to the fuel injection valve to a predetermined pressure, wherein the initial value setting section operates the pressure regulator, and sets the fuel supply pressure in response to an operating condition of the pressure regulator as the initial value.

4. The apparatus according to claim 3, wherein the pressure regulator is a device that discharges the fuel from fuel piping configured to deliver the fuel from the fuel pump to the fuel injection valve.

5. The apparatus according to claim 3, wherein the initial value setting section operates the pressure regulator to cause a change in the fuel supply pressure to the predetermined pressure, which is to be set as the initial value.

6. The apparatus according to claim 2, further comprising:

a sensor that detects a fuel supply pressure applied to the fuel injection valve;

a diagnosing section that diagnoses whether or not the sensor is failed; and a second calculating section that calculates a manipulated variable of the fuel pump, based on the fuel supply pressure detected by the sensor and the target value, wherein the control section controls the fuel pump based on the manipulated variable calculated by the second calculating section when the sensor is normally operated, while controlling the fuel pump based on the manipulated variable calculated by the first calculating section when the sensor is failed, and the initial value setting section sets the initial value of the estimation value of the supply pressure, based on a detection value detected by the sensor immediately before the failure diagnosis of the sensor.

7. The apparatus according to claim 6, wherein the initial value setting section sets the detection value detected by the sensor immediately before the failure diagnosis of the sensor, as the initial value of the estimation value of the supply pressure.

8. The apparatus according to claim 6, further comprising;

a pressure regulator that forcibly changes the fuel supply pressure applied to the fuel injection valve to a predetermined pressure, wherein the initial value setting section operates the pressure regulator and carries out estimation of the supply pressure based on the detection value detected by the sensor immediately before the failure diagnosis of the sensor and based on an operating time duration of the pressure regulator, to thereby set the estimation value of the supply pressure as the initial value.

9. The apparatus according to claim 6, further comprising;

a pressure regulator that forcibly changes the fuel supply pressure applied to the fuel injection valve to a predetermined pressure, wherein the initial value setting section sets the detection value detected by the sensor immediately before the failure diagnosis of the sensor as the initial value during engine operations, whereas during the stop of engine operations, operates the pressure regulator and carries out estimation of the supply pressure, based on the detection value detected by the sensor immediately before the failure diagnosis of the sensor and based on an operating time duration of the pressure regulator, the initial value setting section setting the estimation value of the supply pressure as the initial value.

10. The apparatus according to claim 1, further comprising:

a transient operations detector that detects transient operations of the engine; and an air amount detector that detects an intake air amount of the engine, wherein the first calculating section calculates a correction amount in response to an amount of change in the engine intake air amount, to add the correction amount to the manipulated variable of the fuel pump, during engine transient operations.

11. The apparatus according to claim 1, further comprising;

an air-fuel ratio detector that detects an air-fuel ratio of the engine, wherein the first calculating section calculates a correction amount in response to the air-fuel ratio of the engine, to add the correction amount to the manipulated variable of the fuel pump.

12. The apparatus according to claim 1, further comprising;

a temperature detector that detects the temperature of the fuel, wherein the estimating section corrects the estimation value of the fuel supply pressure in response to the fuel temperature.

13. A fuel supply apparatus for an engine, comprising:
fuel injecting means for injecting fuel to the engine;
fuel supply means for supplying the fuel to the fuel injecting means;
first detecting means for detecting a required fuel flow amount of the engine;
second detecting means for detecting a discharge amount of the fuel supply means;
estimating means for estimating a fuel supply pressure applied to the fuel injecting means, based on the required fuel flow amount of the engine and the discharge amount of the fuel supply means;
first calculating means for calculating a manipulated variable of the fuel supply means, based on the estimated supply pressure and a target value of the supply pressure; and
control means for controlling the fuel supply means based on the manipulated variable.

14. A control method of a fuel supply apparatus which includes a fuel injection valve that injects fuel to an engine and a fuel pump that supplies the fuel to the fuel injection valve, comprising the steps of:
detecting a required fuel flow amount of the engine;
detecting a discharge amount of the fuel pump;
estimating a fuel supply pressure applied to the fuel injection valve, based on the required fuel flow amount of the engine and the discharge amount of the fuel pump;
setting a target value of the fuel supply pressure applied to the fuel injection valve;
calculating a manipulated variable of the fuel pump, based on the estimated supply pressure and the target value; and
controlling the fuel pump based on the manipulated variable.

15. The method according to claim 14, further comprising the step of;
setting an initial value for estimation of the supply pressure, wherein
the step of estimating the fuel supply pressure carries out estimation of the fuel supply pressure applied to the fuel injection valve, based on the required fuel flow amount of the engine, the discharge amount of the fuel pump and the initial value.

16. The method according to claim 15, wherein the fuel supply apparatus further includes;
a pressure regulator that forcibly changes the fuel supply pressure applied to the fuel injection valve to a predetermined pressure, and
the step of setting the initial value comprises the steps of:
operating the pressure regulator; and
setting the fuel supply pressure, which depends on an operating condition of the pressure regulator, as the initial value.

17. The method according to claim 16, wherein the pressure regulator is a device that discharged the fuel from fuel piping configured to deliver the fuel from the fuel pump to the fuel injection valve.

18. The method according to claim 16, wherein the step of operating the pressure regulator includes operating of the pressure regulator to thereby change the fuel supply pressure to the predetermined pressure, and
the step of setting the initial value includes setting of the predetermined pressure as the initial value.

19. The method according to claim 15, wherein the fuel supply apparatus further includes;
a sensor that detects a fuel supply pressure applied to the fuel injection valve, and
the method further comprises the steps of:
diagnosing whether or not the sensor is failed; and
calculating a manipulated variable of the fuel pump, based on the fuel supply pressure detected by the sensor and the target value, and wherein
the step of controlling the fuel pump comprises the steps of:
controlling the fuel pump based on the manipulated variable calculated based on a detection value detected by the sensor when the sensor is normally operated; and
controlling the fuel pump based on the manipulated variable calculated based on the estimation value when the sensor is failed, and
the step of setting the initial value sets the initial value of the estimation value of the supply pressure, based on a detection value detected by the sensor immediately before the failure diagnosis of the sensor.

20. The method according to claim 19, wherein the step of setting the initial value sets the detection value detected by the sensor immediately before the failure diagnosis of the sensor, as the initial value of the estimation value of the supply pressure.

21. The method according to claim 19, wherein the fuel supply apparatus further includes;
a pressure regulator that forcibly changes the fuel supply pressure applied to the fuel injection valve to a predetermined pressure, and
the step of setting the initial value comprises the steps of:
operating the pressure regulator;
estimating the supply pressure based on the detection value detected by the sensor immediately before the failure diagnosis of the sensor and based on an operating time duration of the pressure regulator; and
setting the estimation value as the initial value.

22. The method according to claim 19, wherein the fuel supply apparatus further includes;
a pressure regulator that forcibly changes the fuel supply pressure applied to the fuel injection valve to a predetermined pressure, and
the step of setting the initial value comprises the steps of:
setting the detection value detected by the sensor immediately before the failure diagnosis of the sensor as the initial value during engine operations; and
operating the pressure regulator to estimate the supply pressure, based on the detection value detected by the sensor immediately before the failure diagnosis of the sensor and based on an operating time duration of the pressure regulator, to set the estimation value as the initial value, during the stop of engine operations.

23. The method according to claim 14, further comprising the steps of:
detecting transient operations of the engine; and
detecting an intake air amount of the engine, wherein
the step of calculating the manipulated variable of the fuel pump based on the estimation value of the supply pressure comprises the steps of:
calculating a correction amount in accordance with a change amount of the engine intake air amount during the transient operations of the engine; and
adding the correction amount to the manipulated variable of the fuel pump.

24. The method according to claim 14, further comprising the step of;
detecting an air-fuel ratio of the engine, wherein
the step of calculating the manipulated variable of the fuel pump based on the estimation value of the supply pressure comprises the steps of:

calculating a correction amount in accordance with the air-fuel ratio of the engine; and adding the correction amount to the manipulated variable of the fuel pump.

25. The method according to claim 14, further comprising the step of;

detecting the temperature of the fuel, wherein the step of estimating the fuel pressure comprises the step of;

correcting the estimation value of the fuel supply pressure in accordance with the fuel temperature.

* * * * *